US005259808A

United States Patent [19]

Garr

[11] Patent Number: 5,259,808

[45] Date of Patent: Nov. 9, 1993

[54] FLIP-OVER TOY VEHICLE

[75] Inventor: Anthony R. Garr, Voorhees, N.J.

[73] Assignee: Tyco Investment Corp., Wilmington, Del.

[21] Appl. No.: 4,384

[22] Filed: Jan. 14, 1993

[51] Int. Cl.[5] ..... A63H 17/00

[52] U.S. Cl. ..... 446/437; 446/448; 446/469

[58] Field of Search ..... 446/437, 448, 436, 441, 446/465, 440, 6, 469, 462, 464, 457

[56] References Cited

U.S. PATENT DOCUMENTS

| | | | |
|---|---|---|---|
| 3,959,920 | 6/1976 | Ieda | 446/6 |
| 4,363,187 | 12/1982 | Shinohara | 446/437 |
| 4,466,214 | 8/1984 | Kulesza et al. | 446/437 |
| 4,490,124 | 12/1984 | Ogawa | 446/464 |
| 4,543,073 | 9/1985 | Matsuda | 446/457 X |
| 4,553,947 | 11/1985 | Weiland et al. | 446/443 |
| 4,556,397 | 12/1985 | Arad et al. | 446/436 |
| 4,591,346 | 5/1986 | Ikeda | 446/437 |
| 4,596,534 | 6/1986 | Ishimoto | 446/466 |
| 4,666,420 | 5/1987 | Nagano | 446/443 |
| 4,680,021 | 7/1987 | Maxim | 446/457 |
| 4,696,655 | 9/1987 | D'Andrade et al. | 446/469 |
| 4,702,720 | 10/1987 | Konta et al. | 446/448 |
| 4,822,316 | 4/1989 | Shaffer et al. | 446/466 |
| 4,846,758 | 7/1989 | Chou | 446/437 |
| 4,891,995 | 1/1990 | Lin | 74/3.52 |
| 4,894,042 | 1/1990 | Kamikawa | 446/437 |
| 4,911,669 | 3/1990 | Parker | 446/6 |
| 5,019,009 | 5/1991 | Lin et al. | 446/437 |

FOREIGN PATENT DOCUMENTS

| | | | |
|---|---|---|---|
| 0187895 | 7/1986 | European Pat. Off. . | |
| 472946 | 10/1937 | United Kingdom | 446/437 |
| 2114012 | 8/1983 | United Kingdom . | |
| 2164263 | 3/1986 | United Kingdom . | |

*Primary Examiner*—Mickey Yu

*Attorney, Agent, or Firm*—Panitch Schwarze Jacobs & Nadel

[57] ABSTRACT

A flip-over toy vehicle including a body and a pivot mechanism having a first end and a second end. The first end of the pivot mechanism is pivotally mounted to the body. The pivot mechanism is movable between a drive position wherein the second end of the pivot mechanism is positioned proximate the body and a pivoted position wherein the second end of the pivot mechanism is spaced from the body. A first wheel is rotatably mounted to the first end of the pivot mechanism. A second wheel is rotatably mounted to the second end of the pivot mechanism. A bias member is mounted to bias the second end of the pivot mechanism toward the pivoted position. A latch is movably mounted between a latched position wherein the latch retains the pivot mechanism in the drive position and an unlatched position wherein the pivot mechanism is released from the drive position to move to the pivoted position.

16 Claims, 5 Drawing Sheets

FLIP-OVER TOY VEHICLE

FIELD OF THE INVENTION

The present invention relates generally to toy vehicles and, more particularly, to a toy vehicle which flips over after traveling a predetermined distance.

BACKGROUND OF THE INVENTION

The toy industry generates a voluminous array of toy vehicles annually, including toy motorcycles, cars, trucks, racing vehicles, three wheelers, tanks, pickups, military and space vehicles, construction vehicles and the like. The trend has been to "imitate" real vehicles or to create futuristic toys which capture the imagination.

Toy vehicles are known which have a member which is capable of moving downwardly toward a support surface and contacting the support surface. In response to contact of the member with the support surface, the toy vehicle is raised or otherwise moved with respect to the support surface. Typically, the contact member causes rotation of the vehicle about the center of rotation of one of its axles to lift up either the front or the back end of the vehicle. Other known toy vehicles locate the member to one side or the other of the vehicle such that upon contact of the member with the support surface one side or other of the vehicle is elevated with respect to the other side to essentially tip the vehicle sideways.

Some of the vehicles noted in the previous paragraph are capable of being completely flipped over such that they roll about portions of their outer body doing somersault-like moves. For the most part, the vehicles which are capable of rolling utilize a member which contacts a support surface and then, in a controlled manner, is further extended from the vehicle to slowly roll the vehicle on the support surface. A number of other vehicles, however, utilize a member which is violently or very rapidly thrust towards the support surface such that the vehicle very dramatically is flipped or upset.

Toy manufacturers are always looking for new actions to make toys unusual and enhance their entertainment value, and it is believed a new flip-over action in a toy vehicle would be desirable.

SUMMARY OF THE INVENTION

Briefly stated, the present invention is a toy vehicle which includes a body and a pivot mechanism. The pivot mechanism has a first end and a second end. The first end of the pivot mechanism is pivotally mounted to the body. The pivot mechanism is movable between a drive position wherein the second end of the pivot mechanism is positioned proximate the body and a pivoted position wherein the second end of the pivot mechanism is spaced from the body. A first wheel is rotatably mounted to the first end of the pivot mechanism. A second wheel is rotatably mounted to the second end of the pivot mechanism. A bias member is mounted to bias the second end of the pivot mechanism toward the pivoted position. A latch is movably mounted between a latched position wherein the latch retains the pivot mechanism in the drive position and an unlatched position wherein the pivot mechanism is released from the drive position to move to the pivoted position.

In another aspect, the present invention is a toy vehicle comprising a pivot mechanism having a first end and a second end. A first surface contacting wheel is rotatably mounted on the first end of the pivot mechanism. A second surface contacting wheel is rotatably mounted on the second end of the pivot mechanism. A remaining portion of the vehicle is pivotally coupled with the first end of the pivot mechanism. The remaining portion of the vehicle is movable between a drive position wherein the remaining portion of the vehicle is proximate the second end of the pivot mechanism and a pivoted position in which the remaining portion of the vehicle is raised away from the second end of the pivot mechanism. A bias member is mounted in the vehicle so as to bias the remaining portion of the vehicle toward the pivoted position. A latch is mounted to move between a latched position wherein the latch retains the remaining portion of the vehicle in the drive position and an unlatched position wherein the remaining portion of the vehicle is released from the drive position to move to the pivoted position.

BRIEF DESCRIPTION OF THE DRAWINGS

The foregoing summary, as well as the following detailed description, will be better understood when read in conjunction with the appended drawings. For the purpose of illustrating the invention, there is shown an embodiment which is presently preferred, it being understood, however, that this invention is not limited to the precise arrangement and instrumentality shown. In the drawings.

DESCRIPTION OF THE PREFERRED EMBODIMENT

Figure 1:
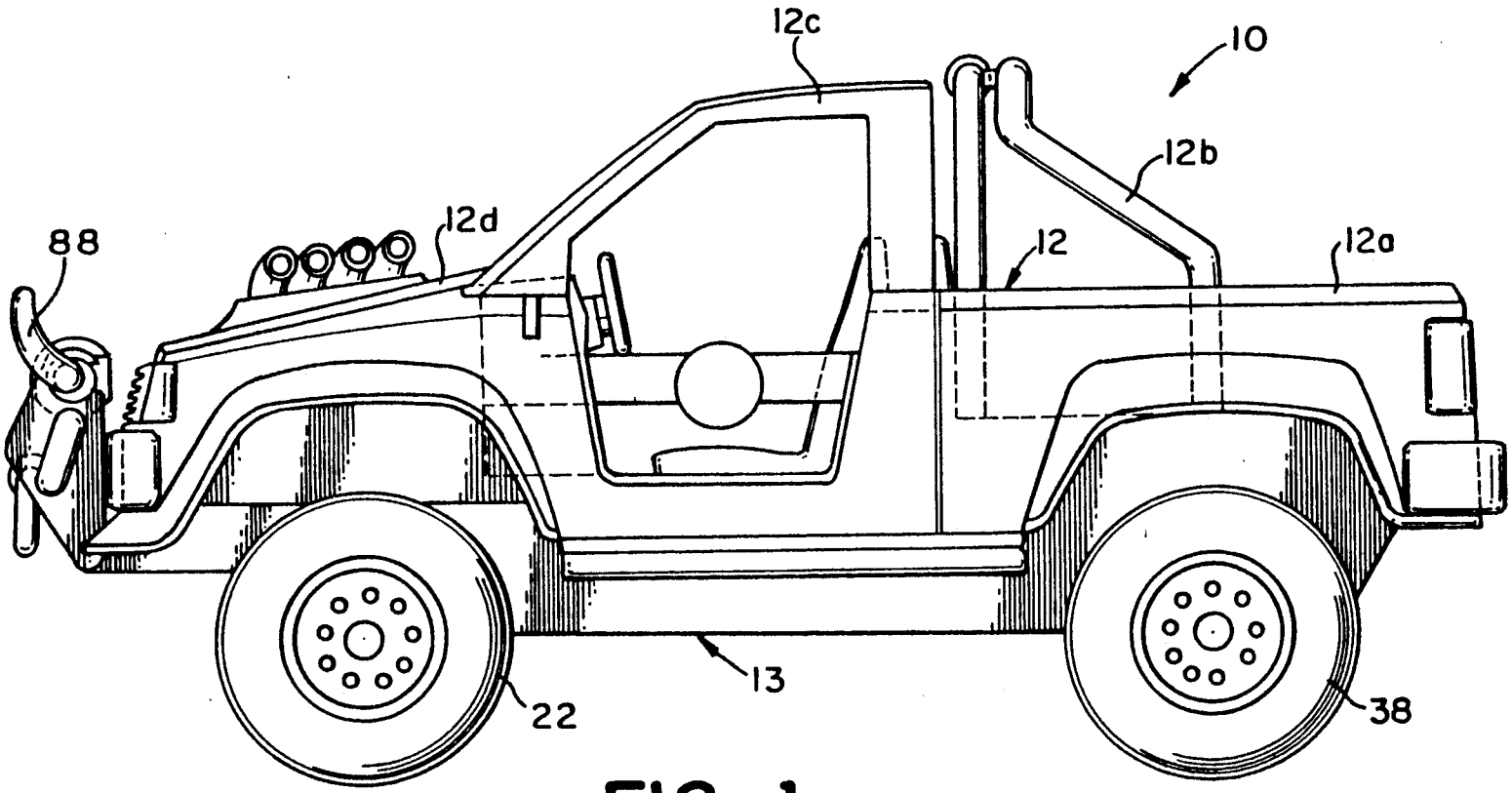
FIG. 1 is a left side elevational view of a toy vehicle in accordance with the present invention.

Certain terminology is used in the following description for convenience only and is not limiting. The words "right," "left," "lower" and "upper" designate directions in the drawing to which reference is made. The words "inwardly" and "outwardly" refer to directions toward and away from, respectively, the geometric center of the toy vehicle and designated parts thereof. The terminology includes the words above specifically mentioned, derivatives thereof and words of similar import.

Referring now to the drawings in detail, wherein like numerals indicate like elements throughout, there is shown in FIGS. 1 through 6 a preferred embodiment of a toy vehicle, generally designated 10, in accordance with the present invention. The toy vehicle 10 preferably includes a body 12 which is generally in the form of a miniaturized pickup truck. The body 12 of the toy vehicle 10 includes the standard elements of a pickup truck, including a bed 12*a*, roll bar 12*b*, cab 12*c*, hood 12*d*, etc.

It is understood by those skilled in the art, that the present invention is not limited to any particular type of toy vehicle body. That is, the body 12 could be shaped in the manner of a passenger vehicle, tractor trailer, van, tricycle, construction vehicle or space vehicle. In the present embodiment, it is preferred that the body 12 be constructed of a polymeric material, such as ABS. It is understood by those skilled in the art that the body 12 could be constructed of other materials without departing from the spirit and scope of the invention, including metallic materials, wood and/or composites. In the present embodiment, it is preferred that the body 12 and the remaining elements of the toy vehicle 10 which are constructed of polymeric material be constructed by a suitable molding process or processes, as is well understood by those skilled in the art.

Figure 4:
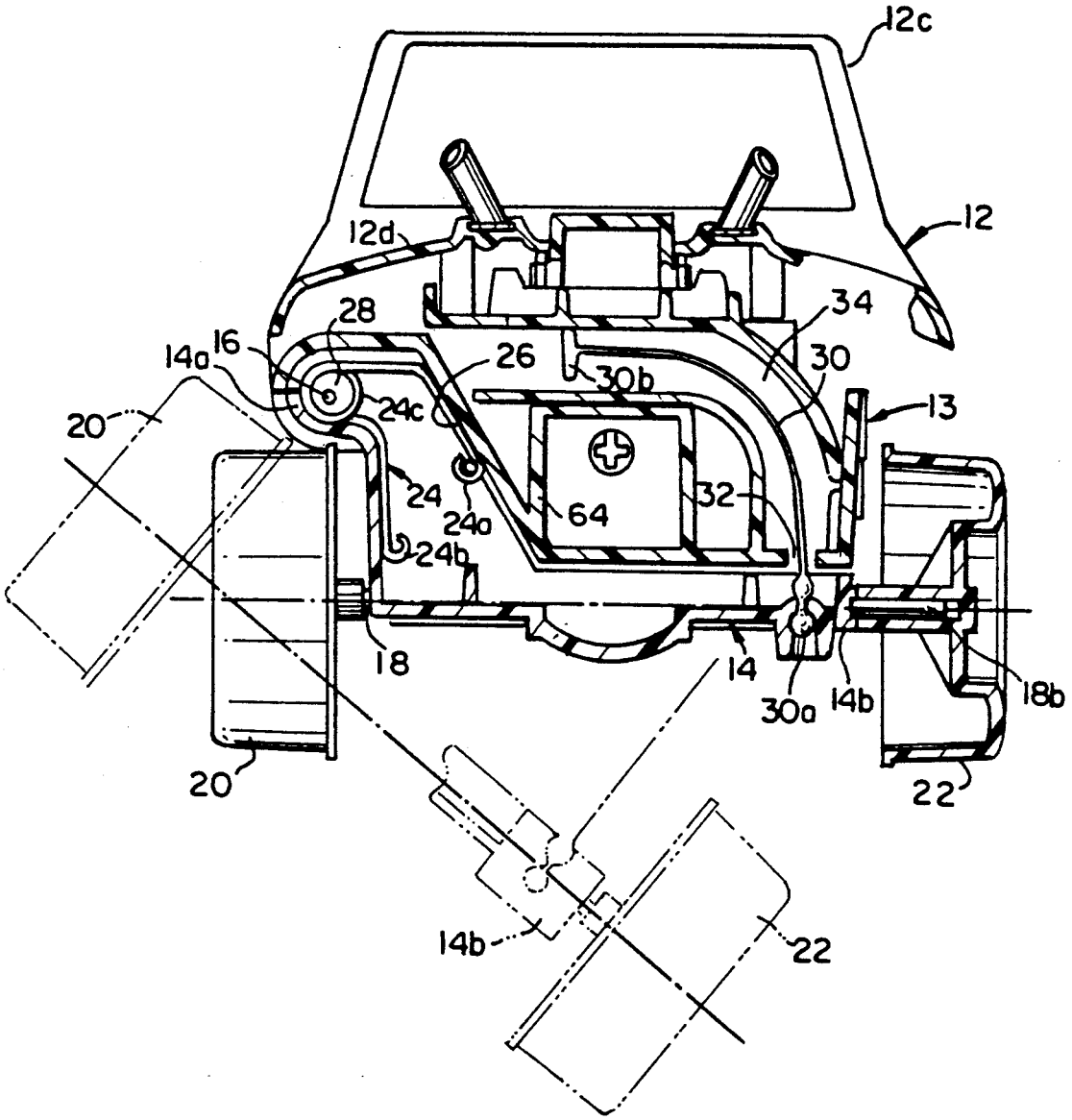
FIG. 4 is a cross-sectional view of the toy vehicle shown in FIG. 3 taken along lines 4—4 of FIG. 3.
Figure 5:
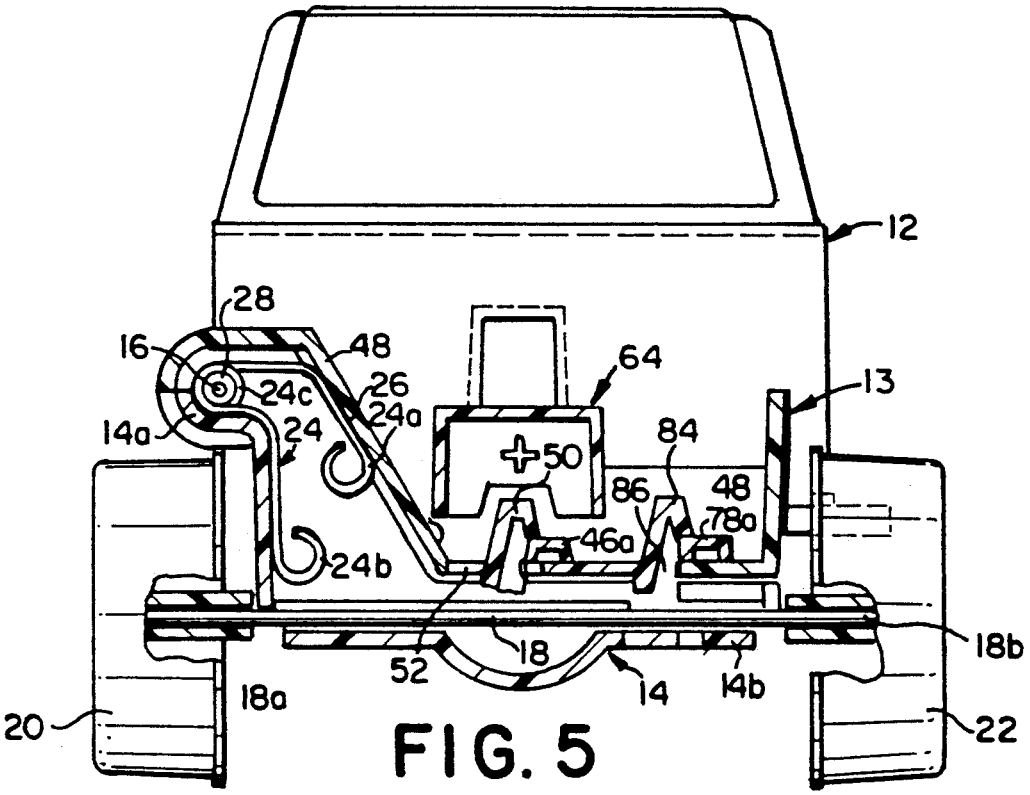
FIG. 5 is a cross-sectional view of the toy vehicle shown in FIG. 3 taken along lines 5—5 of FIG. 3.

Referring now to FIGS. 4 and 5, there is shown a pivot mechanism 14 having a first end 14*a* and a second end 14*b*. The first end 14*a* of the pivot mechanism 14 is pivotally mounted to the body 12. More particularly, the body 12 preferably includes a chassis 13 disposed beneath the upper components of the body (i.e., hood 12*d*, cab 12*c* and bed 12*a*) for receiving the wheels and various elements of the present invention, as described in more detail hereafter. In the present embodiment, it is preferred that the first end 14*a* of the pivot mechanism 14 be pivotally mounted to the chassis 13 of the body 12 by a pin connection. That is, a pin 16 extends through a suitably sized aperture in the first end 14*a* of the pivot mechanism 14 and is secured to the chassis 13 to allow the pivot mechanism 14 to pivot with respect to the body 12, in a manner well understood by those skilled in the art. This permits the pivot mechanism 14 to pivot with respect to the body 12 between a drive position (shown in a solid line in FIGS. 4 and 5) wherein the second end 14*b* of the pivot mechanism 14 is positioned proximate the body 12 and a pivoted position (shown in phantom in FIG. 4) wherein the second end 14*b* of the pivot mechanism 14 is spaced from the body 12.

As shown in FIG. 5, an axle 18 is rotatably mounted on the bottom of the pivot mechanism 14. The axle 18 includes a first end 18*a* and a second end 18*b*. The first end 18*a* of the axle 18 is positioned proximate the first end 14*a* of the pivot mechanism 14. Similarly, the second end 18*b* of the axle 18 is positioned proximate the second end 14*b* of the pivot mechanism 14. A first wheel 20 is fixed to the first end 18*a* of the axle 18 such that the first wheel 18 is rotatably mounted to the first end 14*a* of the pivot mechanism 14. A second wheel 22 is fixed to the second end 18*b* of the axle 18 such that the second wheel 18 is rotatably mounted to the second end 14*b* of the pivot mechanism 14.

While in the present embodiment, it is preferred that the first and second wheels 20, 22 be fixed to the rotatably mounted axle 18. It is understood by those skilled in the art that other methods can be utilized for mounting the first and second wheels 20, 22 to the pivot mechanism 14. For instance, the first and second wheels 20, 22 could be independently rotatably mounted directly to the first and second ends 14*a*, 14*b* of the pivot mechanism 14 in a manner well understood by those skilled in the art.

It is also understood by those skilled in the art that the present invention is not limited to providing wheels on the first and second ends 14*a*, 14*b* of the pivot mechanism 14. For instance, a track mechanism or sled-type rail or a single front wheel could be used without departing from the spirit and scope of the invention.

As best shown in FIGS. 4 and 5, a bias member 24 is mounted to bias the second end 14*b* of the pivot mechanism 14 from the drive position, shown in solid in all of the figures, toward the pivoted position, shown in phantom in FIG. 4. In the present embodiment, the bias member 24 is preferably comprised of a torsion spring interconnected between the pivot mechanism 14 and the chassis 13. More particularly, the chassis 13 includes a bearing surface 26 which receives a first end 24*a* of the bias member 24. The pivot mechanism 14 is preferably L-shaped in cross section. One leg of the pivot mechanism 14 extends generally along the axle 18 and a second leg of the pivot mechanism 14 extends upwardly from the first leg toward the pin 16. The second leg receives the second end 24*b* of member 24 such that when the pivot mechanism 14 is in the drive position, the bias member 24 is compressed to apply a force against the pivot mechanism 14.

In the present embodiment, it is preferred that the bias member 24 bias the second end 14*b* of the pivot mechanism 14 from the drive position to the pivoted position with sufficient force to cause the toy vehicle 10 to flip over. The particular force necessary to cause the toy vehicle 10 to flip over varies with the design of the toy vehicle 10 and takes into consideration such factors as the weight of the toy vehicle, the center of gravity of the toy vehicle and other engineering parameters known to those skilled in the art.

The pivot mechanism 14 has a predetermined width for accommodating the width of the bias member 24. The bias member 24 is preferably positioned to receive the pin 16 and a generally cylindrical mounting member 28 through its coil area 24*c*. The mounting member 28 receives the pin 16 through its center for securely mounting the bias member 24 to the chassis 13. The first end 14*a* of the pivot mechanism 14 is generally curved to provide a cup-shaped area for receiving the coil 24*c* of the bias member 24.

While in the present embodiment, it is preferred that the bias member 24 be comprised of a torsion spring, it is understood by those skilled in the art that the present invention is not limited to any particular type of bias member. For instance, a coil spring or elastomeric member could be interposed between the bearing surface 26 and the first end 14*a* of the pivot mechanism 14 or otherwise mounted in the vehicle in an appropriate manner without departing from the spirit and scope of the invention.

Referring now to FIG. 4, the toy vehicle 10 includes means for limiting the pivotal motion of the pivot mechanism 14 to the pivoted position. In the motion is comprised of a cord 30 having a first end 30*a* secured to the second end 14*b* of pivot mechanism 14 with a snap-fit arrangement, as is understood by those skilled in the art. The second end 30*b* of the cord 30 is enlarged to prevent it from passing through an aperture 32 in the chassis 13. A guide channel 34 is provided in the chassis 13 for reciprocally receiving the cord 30. The aperture 32 is located at the end of the channel 34 which is positioned proximate the second end 14*b* of the pivot mechanism 14 when the pivot mechanism 14 is in the drive position. When the pivot mechanism 14 is biased to the pivoted position, the second end 30*b* of the cord 30 cannot pass through the aperture 32, thereby limiting the range of pivotal motion of the pivot mechanism 14 to the length of the cord 30.

While in the present embodiment, it is preferred that the means for limiting the pivotal motion of the pivot mechanism 14 be comprised of the cord 30, aperture 32 and channel 34, it is understood by those skilled in the art that other devices could be used for limiting the pivotal motion of the pivot mechanism 14. For instance, a stop (not shown) could be mounted on the bearing surface 26 of the chassis 13 for receiving the first end 14*a* of the pivot mechanism 14 at a position which corresponds to the pivoted position of the pivot mechanism 14.

Figure 2:
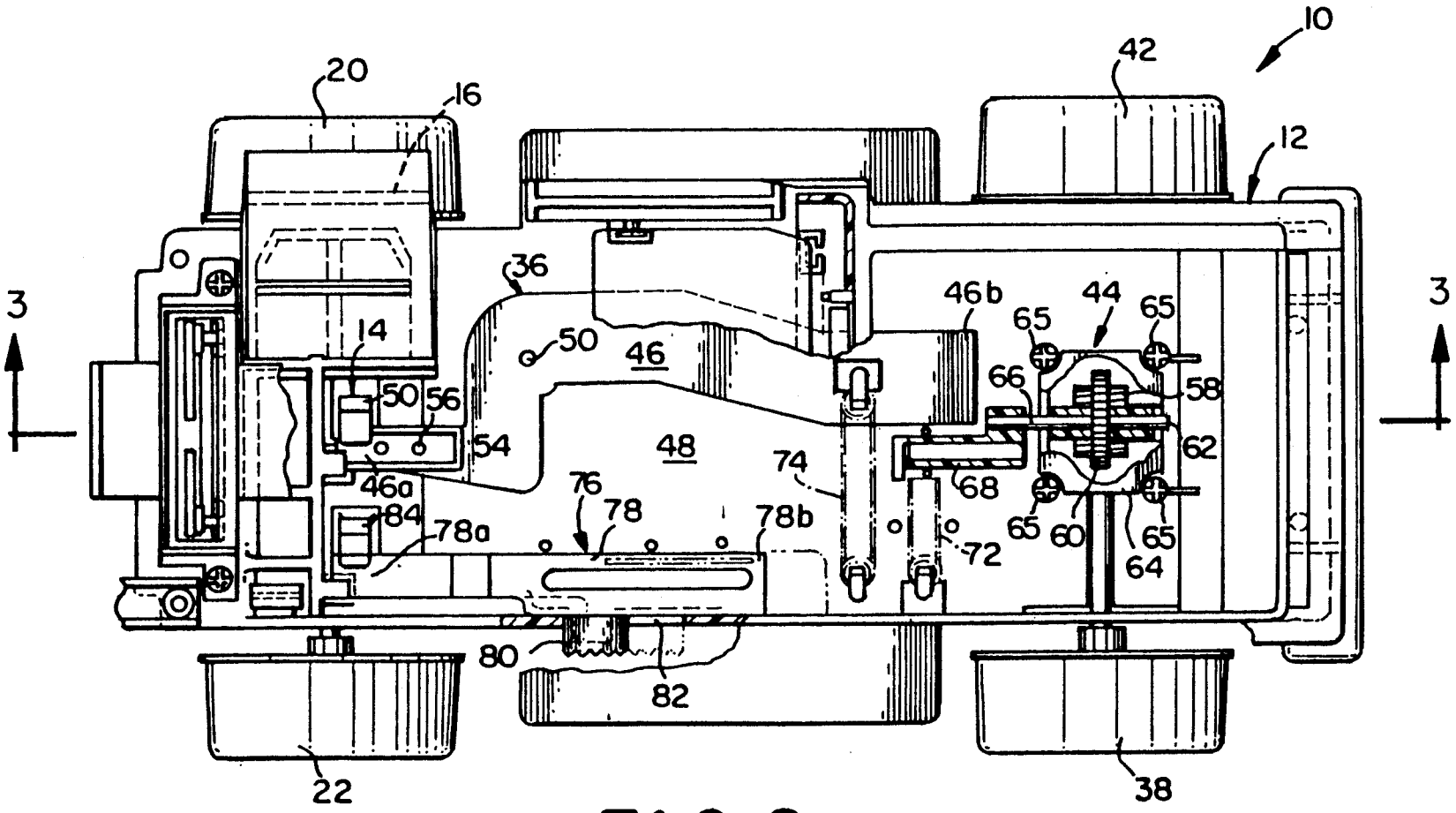
FIG. 2 is a top plan view, partially in cross section and partially broken away, of the toy vehicle shown in FIG. 1.

Referring now to FIGS. 2 and 5, in the present embodiment, the toy vehicle 10 preferably includes a latch 36 movably mounted between a latched position wherein the latch 36 retains the pivot mechanism 14 in the drive position and an unlatched position wherein the pivot mechanism 14 is released from the drive position to move to the pivoted position under the force of the bias member 24. The details of the latch 36 are described in more detail hereinafter.

Figure 6:
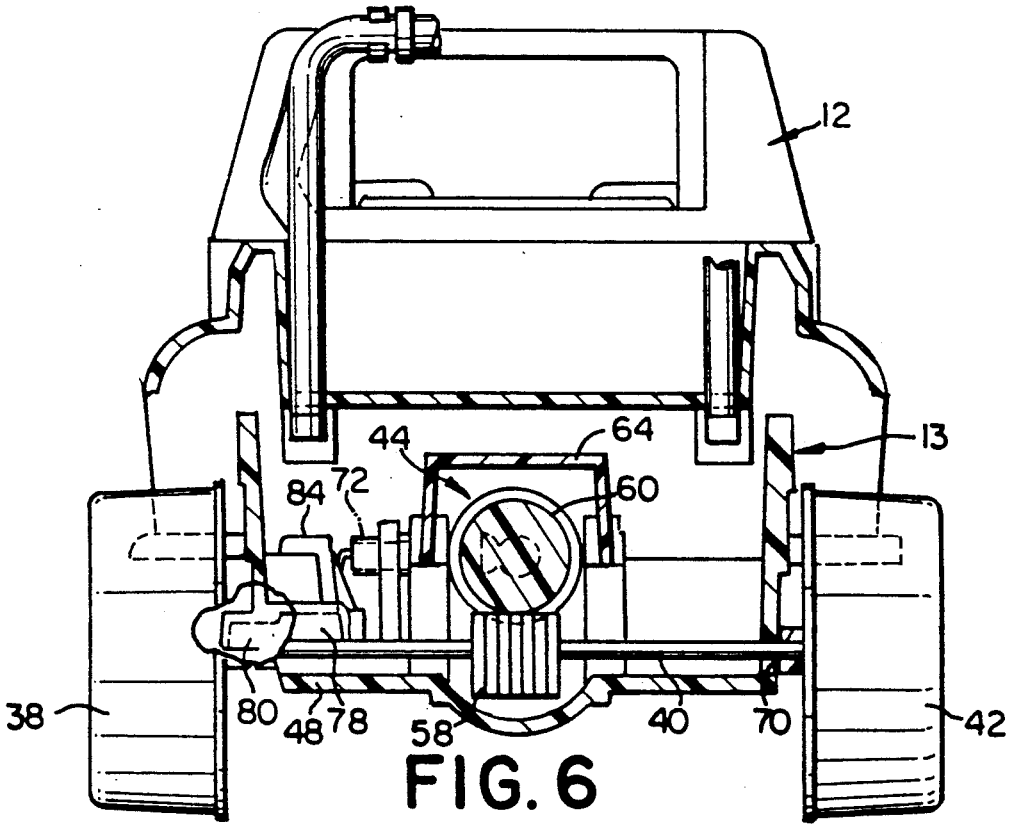
FIG. 6 is a cross-sectional view of the toy vehicle shown in FIG. 3 taken along lines 6—6 of FIG. 3.

Referring now to FIG. 6, a third wheel 38 is rotatably mounted to the body 12. More particularly, an axle 40 is rotatably mounted to the chassis 13 beneath the bed 12*a* of the toy vehicle 10. As in the first and second wheels 20, 22, the third wheel 38 is fixed to rotate with the axle 40. Similarly, a fourth wheel 42 is fixed to rotate with the axle 40. Upon pushing the toy vehicle 10 across a support surface, such as a floor (not shown), the first, second, third and fourth wheels 20, 22, 38, 42 and the associated axles 18, 40, respectively, rotate in a manner well understood by those skilled in the art.

Referring now to FIGS. 2 and 6, an actuator 44 is interconnected between the third wheel 38 and the latch 36 so as to move the latch 36 from the latched position to the unlatched position in response to rotation of the third wheel 38. In the present embodiment, the latch 36 is comprised of a lever 46 pivotally mounted to the body 12. More particularly, the lever 46 is pivotally mounted to a chassis 13 beneath the cab 12*c* of the toy vehicle 10 by a pin 50, which permits the lever 46 to pivot horizontally with respect to the chassis 13. As shown in FIG. 2, the lever 46 has a first end 46*a* in engagement with the pivot mechanism 14 when the pivot mechanism 14 is in the drive position and a second end 46*b* coupled with the actuator 44.

Referring now to FIG. 5, the pivot mechanism 14 includes a first catch 50, which is generally V-shaped in cross section, extending upwardly through an aperture 52 in the chassis 13 when the pivot mechanism 14 is in the drive position. More particularly, when the pivot mechanism 14 is in the drive position, a space exists between the first catch 50 and the chassis 13 for receiving the first end 46*a* of the lever 46 to securely retain the pivot mechanism 14 in the drive position. The force applied by the bias member 24 clamps the first end 46*a* of the lever 46 between the first catch 50 and the chassis 13. As shown in FIG. 2, a metallic plate 54 is secured to the upper surface of the first end 46*a* of the lever 46 to inhibit the effects of wear. The metallic plate 54 is secured to the first end 46*a* of lever 46 by standard fasteners, such as screws 56. The metallic plate 50 is omitted from FIG. 5 for purposes of clarity.

Referring now to FIGS. 2 and 6, in the present embodiment, it is preferred that the actuator 44 be comprised of a worm gear 58 fixed for rotation with the third wheel 38. That is, the worm gear 58 preferably is rotatably fixed to the axle 40 and is generally centrally disposed between the third and fourth wheels 38, 42. A spur gear 60 is drivingly connected to the worm gear 58 for rotation therewith. As shown in FIG. 6, the spur gear 60 is disposed generally above the worm gear 58 and is mounted for rotation through a shaft 62 which is rotatably mounted to an actuator housing 64. The actuator housing 64 is generally in the form of a parallelepiped and is secured to the chassis 13 by standard screws 65. The shaft 62 includes an exposed end 66 which extends outwardly from the actuator housing 64 toward the front end of the toy vehicle 10. As best shown in FIG. 2, a finger 68 is eccentrically mounted to and extends from the spur gear 60. More particularly, the finger 68 is eccentrically mounted to the exposed end 66 of the shaft 62. The finger 68 extends toward the front of the toy vehicle 10 such that the finger 68 and the second end 46*b* of lever 46 are juxtaposed.

Upon rotation of the axle 40, which is caused by rotation by the third or fourth wheels 38, 42, the worm gear 58 begins to rotate thereby causing the spur gear 60 to rotate. When the spur gear 60 rotates, the shaft 62 rotates therewith to cause the finger 68 to move towards the second end 46*b* of the lever 46. When the finger 68 engages the second end 46*b* of lever 46 and continues to move in the same direction, the first end 46*a* of the lever 46 moves in the opposite direction due to the pivotal mounting of lever 46 to the chassis 13. This eventually causes the first end 46*a* of lever 46 to move away from the first catch 50 toward the second wheel 22 to release the first catch 50 and cause the pivot mechanism 14 to pivot downwardly into the pivoted position due to the force provided by the bias member 24. As mentioned above, this force is sufficient to cause the toy vehicle 10 to flip over.

Figure 3:
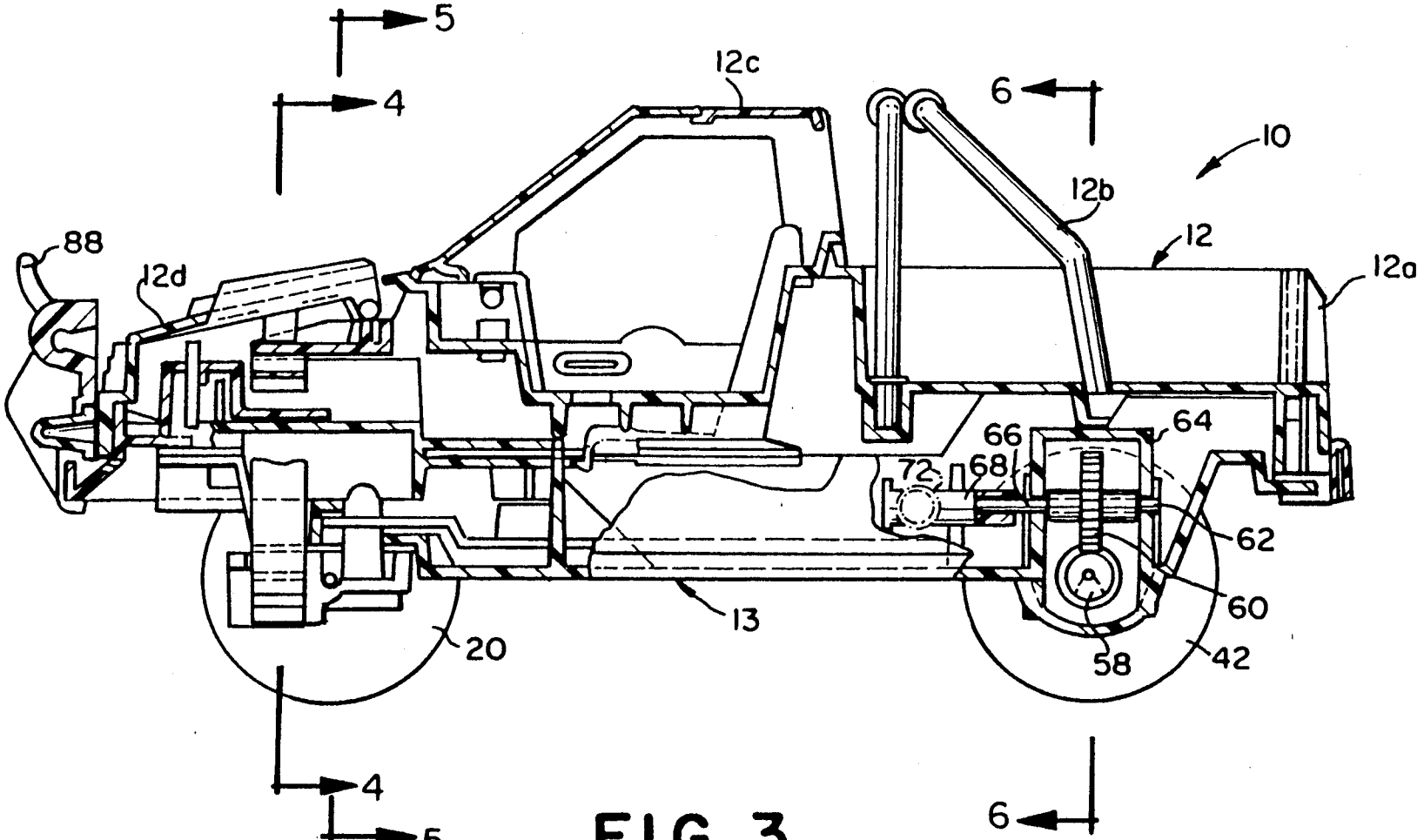
FIG. 3 is a cross-sectional view of the toy vehicle shown in FIG. 2 taken along lines 3—3 of FIG. 2.

Referring now to FIGS. 3 and 6, in the present embodiment, it is preferred that the actuator 44 be responsive to rotation of the third and fourth wheels 38, 42 only when the third and fourth wheels 38, 42 are rotating against a surface supporting the toy vehicle 10 or otherwise raised sufficiently into the body. More particularly, the worm gear 58, axle 40 and third and fourth wheels 38, 42 are mounted to move vertically in vehicle 10 with respect to the body 12 and the spur gear 60 between a first position (shown in FIG. 6) where the worm gear 58 is drivingly connected to the spur gear 60 and a second position (not shown) wherein the worm gear 58 is spaced from the spur gear 60. That is, the third and fourth wheels 38, 42 and worm gear 58 are in the first position when the third and fourth wheels 38, 42 are on or are rotated against a surface supporting the toy vehicle 10. In the present embodiment, it is preferred that the axle 40 be mounted in a pair of slots 70 in the chassis 13 of the body 12. In this arrangement, when the toy vehicle 10 is lifted from the supporting surface, the third and fourth wheels 38, 42 and axle 40 are caused to slide downwardly due to the force of gravity such that the worm gear 58 becomes disengaged from the spur gear 60. When worm gear 58 disengages from the spur gear 60, a first spring 72 interconnected between the finger 68 and the chassis 13 causes the finger 68 to move toward the third wheel 38 or the reset position. Similarly, a second spring 74 interconnected between the second end 46*b* of lever 46 and the chassis 13 causes the second end 46*b* of lever 46 to move toward the third wheel 38 or the latched position.

In the present embodiment it is preferred that springs (not shown) be disposed between the axle 40 and chassis 13 for biasing the third and fourth wheels downwardly, as viewed in FIG. 6. This prevents the worm gear 58 from engaging the spur gear 60 when the toy vehicle 10 is upside down unless the axle 40 pushed toward the chassis 13. The springs should not be strong enough to prevent the worm gear 58 from engaging the spur gear 60 when the toy vehicle 10 is in the upright position on a supporting surface. This assists in preventing the pivot mechanism 14 from being activated when the toy vehicle 10 is upside down and, therefore, adds to the overall safety of the toy vehicle 10.

In the present embodiment, it is preferred that the first and second springs 72, 74 be coil springs. However, it is understood by those skilled in the art that other means, such as elastomeric members, could be used in place of the first and second springs 72, 74.

While in the present embodiment it is preferred that the pivot mechanism 14 be released from the drive position by the latch 36 and actuator 44, it is understood by those skilled in the art that other devices could be used to move the first end 46*a* of the lever 46 toward and away from the first catch 50 without departing from the spirit and scope of the invention. That is, the present invention is not limited to any particular type of device for retaining the pivot mechanism in the drive position or for releasing the pivot mechanism to the pivoted position.

Referring now to FIG. 2, the toy vehicle 10 includes a locking mechanism 76 for optionally locking the pivot mechanism 14 in the drive position. In the present embodiment, the locking mechanism is comprised of a second latch 78 reciprocally mounted to the chassis 13 for reciprocal movement in a path generally parallel to the lever 46. The second latch 78 includes a first end 78*a* positioned proximate the pivot mechanism 14 and a second end 78*b* positioned beneath the cab 12*c* of the toy vehicle 10. The second end 78*b* of the catch 78 includes a finger button 80 extending outwardly therefrom through an aperture 82 in the body 12 of the toy vehicle 10.

Referring now to FIG. 5, the pivot mechanism 14 includes a second catch 84 extending upwardly therefrom through an aperture 86 in the chassis 13. The second catch 84 is generally identical to the first catch 50. Accordingly, further description thereof is omitted for the purposes of convenience only, and is not limiting. The first end 78*a* of the second latch 78 is disposed between the second catch 84 and the chassis 13 to lock the pivot mechanism 14 in the drive position. When the first end 78*a* of the second latch 78 is moved toward the rear of the toy vehicle 10 such that the first end 78*a* of the second latch 78 is not positioned between the second catch 84 and the chassis 13, the pivot mechanism 14 is free to move to the pivoted position when the first end 46*a* of the lever 46 is moved out of engagement with the first catch 50. Referring now to FIG. 2, to move the second latch 78 toward and away from the second catch 84, the user merely grasps the finger button 80 and slides it between a first position wherein the pivot mechanism 14 is locked in the drive position (shown in solid lines in the figures) and a second position wherein the pivot mechanism 14 is free to move between the drive and pivoted positions (shown in phantom in FIG. 2).

While it is preferred that the toy vehicle 10 be of the push type, it is understood by those skilled in the art that a drive motor could be incorporated in the toy vehicle 10 without departing from the spirit and scope of the invention. It is also understood by those skilled in the art that there are other features of the toy vehicle 10 which are shown in the drawings and included in the commercial form of the toy vehicle 10 which enhance the play value of the toy vehicle 10. Such features are not described herein since they are not related to the present invention. Such features include, for example, running boards which fold out from the sides of the body 12 to selectively prevent the toy vehicle 10 from flipping over. In addition, the bull horn bumper 88 springs out from the front end of the toy vehicle 10.

In use, the toy vehicle 10 is positioned on a supporting surface, such as a floor of a building (not shown), such that the third and fourth wheels 38, 42 and axle 40 move upwardly in the slot 70 until the worm gear 58 engages the spur gear 60. The user then pushes the toy vehicle in a forward direction. As the third and fourth wheels 38, 42 begin to rotate, the worm gear 58 rotates therewith. Rotation of the worm gear 58 causes the spur gear 60 and shaft 62 to also rotate. As the shaft 62 rotates, the finger 68 moves toward the second end 46*b* of the lever 46. Once the finger 68 engages the second end 46*b* of the lever 46, the second end 46*b* of the lever 46 begins to move toward the fourth wheel 42 as the third and fourth wheels 38, 42 continue to rotate.

Movement of the second end 46*b* of lever 46 toward the fourth wheel 42 causes the first end 46*a* of the lever 46 to move toward the second wheel 22. Once the first end 46*a* of the lever 46 clears the first catch 50, assuming the first end 78*a* of the second latch 78 is not in the locked position between the second catch 84 and the chassis 13, the bias member 24 causes the second end 14*b* of the pivot mechanism to abruptly pivot downwardly or the body 12 to pivot upwardly with sufficient force to cause the toy vehicle 10 to flip over. Stated another way, pivot mechanism 14 remains in its original position while the remaining portion of the vehicle 10, being pivotally coupled with the first end 14*a* of the pivot mechanism moves between the drive position, shown in solid in all of the figures, to a pivoted position in which the remaining portion of the vehicle is raised away from the second end 14*b* of the pivot mechanism 14. This would correspond to the appearance of vehicle 10 in FIG. 4 if that figure were rotated approximately forty-five degrees counterclockwise until the phantomed wheels 20, 22 were horizontal. In the preferred embodiment, the flip-over action typically takes place between six and eight feet of forward or backward travel (plus or minus one foot). This range could be changed by modifying the gear ratios of the worm gear 58 and spur gear 60 without departing from the spirit and scope of the invention.

When the user retrieves the toy vehicle 10 and lifts it off the supporting surface, the lever 46 is automatically returned to the latched position. That is, upon lifting the toy vehicle 10, the third and fourth wheels 38, 42, axle 40 and worm gear 58 slide downwardly in the slots 70 and the worm gear 58 becomes disengaged with the spur gear 60. The first and second springs 72, 74 then cause the finger 68 to return to its initial position and second end 46*b* of lever 46 to return to the latched position. The user then merely needs to push the pivot mechanism 14 toward the drive position until the first catch 50 receives the first end 46*a* of lever 46, thereby locking the pivot mechanism 14 in the drive position. The V-shaped configuration of the first catch 50 biases the first end 46*a* of the lever 46 towards the right, as shown in FIG. 5, during the latching process. Once the catch 50 clears the first end 46*a* of lever 46, the first end 46*a* of lever 46 snaps into place due to the force supplied by the second spring 74.

As discussed above, the user may render the latch 36 ineffective to allow the toy vehicle 10 to be used merely as a push-and-play toy vehicle. When the second latch 78 is disposed in the locked position such that the first end 78a is disposed between the second catch 84 and the chassis 13, regardless of the position of the first end 46a of the lever 46, the pivot mechanism 14 cannot move from the drive position to the pivoted position. In this mode, when the user pushes the toy vehicle 10 along a supporting surface, the actuator 44 and latch 36 work in the same manner as described above except that the end result is not accomplished. To engage the latch 36 of the toy vehicle 10 the user merely slides the second latch 78 toward the rear of the toy vehicle 10 using the finger button 80 until the first end 78a of the second latch 78 clears the second catch 84.

From the foregoing description, it can be seen that the present invention comprises a flip-over toy vehicle. It will be appreciated by those skilled in the art that changes could be made to the embodiment described in the foregoing description without departing from the broad inventive concept thereof. It is understood, therefore, that this invention is not limited to the particular embodiment disclosed, but is intended to cover all modifications which are within the scope and spirit of the invention as defined by the appended claims.

I claim:

1. A toy vehicle comprising:

a) a body;

b) a pivot mechanism having a first end and a second end, said first end of said pivot mechanism being pivotally mounted to said body, said pivot mechanism being movable between a drive position wherein said second end of said pivot mechanism is positioned proximate said body and a pivoted position wherein said second end of said pivot mechanism is spaced from said body;

c) a first wheel rotatably mounted to said first end of said pivot mechanism;

d) a second wheel rotatably mounted to said second end of said pivot mechanism;

e) a bias member mounted so as to bias said second end of said pivot mechanism toward said pivoted position; and f) a latch movably mounted between a latched position wherein said latch retains said pivot mechanism in said drive position and an unlatched position wherein said pivot mechanism is released from said drive position to move to said pivoted position.

2. The toy vehicle as recited in claim 1 wherein said bias member biases said second end of said pivot mechanism from said drive position to said pivoted position when said latch is moved from said latched position to said unlatched position with sufficient force to cause the toy vehicle to flip over.

3. The toy vehicle as recited in claim 1 further including a third wheel rotatably mounted to said body and an actuator interconnected between said third wheel and said latch so as to move said latch from said latched position to said unlatched position in response to rotation of said third wheel.

4. The toy vehicle as recited in claim 3 wherein said actuator is responsive to rotation of said third wheel when the vehicle is upright and when said third wheel is raised sufficiently up into the body while the wheel is rotating.

5. The toy vehicle as recited in claim 3 wherein said latch comprises a lever pivotally mounted to said body, said lever having a first end in engagement with said pivot mechanism when said pivot mechanism is in said drive position and a second end coupled with said actuator.

6. The toy vehicle as recited in claim 5 wherein said actuator comprises a worm gear fixed for rotation with said third wheel, a spur gear drivingly connected to said worm gear for rotation therewith, a finger eccentrically mounted to and extending from said spur gear, said finger engaging and moving said second end of said lever upon rotation of said third wheel to move said latch to said unlatched position.

7. The toy vehicle as recited in claim 6 wherein said worm gear and said third wheel are mounted to move with respect to said body and said spur gear between a first position wherein said worm gear is drivingly connected to said spur gear and a second position wherein said worm gear is spaced from said spur gear, said third wheel and worm gear being in said first position when said third wheel is rotating against a surface supporting the toy vehicle.

8. The toy vehicle as recited in claim 1 further including a locking mechanism optionally retaining the pivot mechanism in the drive position regardless of the position of the latch.

9. A toy vehicle comprising:

a) a pivot mechanism having a first end and a second end;

b) a first surface contacting wheel rotatably mounted on said first end of said pivot mechanism;

c) a second surface contacting wheel rotatably mounted on said second end of said pivot mechanism;

d) a remaining portion of the vehicle being pivotally coupled with said first end of said pivot mechanism, the remaining portion of the vehicle being movable between a drive position wherein the remaining portion of the vehicle is proximate the second end of the pivot mechanism and a pivoted position in which the remaining portion of the vehicle is raised away from the second end of the pivot mechanism;

e) a bias member mounted in the vehicle so as to bias the remaining portion of the vehicle toward said pivoted position; and f) a latch mounted to move between a latched position wherein said latch retains the remaining portion of the vehicle in said drive position and an unlatched position wherein the remaining portion of the vehicle is released from the drive position to move to said pivoted position.

10. The toy vehicle as recited in claim 9 wherein said bias member biases said remaining portion of said vehicle from said drive position to said pivoted position with sufficient force to cause the toy vehicle to flip over when said latch is moved from said latched position to said unlatched position.

11. The toy vehicle as recited in claim 9 further including a third wheel rotatably mounted to said remaining portion of the vehicle and an actuator interconnected between said third wheel and said latch so as to move said latch from said latched position to said unlatched position in response to rotation of said third wheel.

12. The toy vehicle as recited in claim 1 wherein said actuator is responsive to rotation of said third wheel when the vehicle is upright and when said third wheel is raised sufficiently up into the remaining portion of the vehicle while the wheel is rotating.

13. The toy vehicle as recited in claim 11 wherein said latch comprises a lever pivotally mounted to said remaining portion of the vehicle, said lever having a first end in engagement with said pivot mechanism when said remaining portion of the vehicle is in said drive position and a second end coupled with said actuator.

14. The toy vehicle as recited in claim 13 wherein said actuator comprises a worm gear fixed for rotation with said third wheel, a spur gear drivingly connected to said worm gear for rotation therewith, a finger eccentrically mounted to and extending from said spur gear, said finger engaging and moving said second end of said lever upon rotation of said third wheel to move said latch to said unlatched position.

15. The toy vehicle as recited in claim 14 wherein said worm gear and said third wheel are mounted to move with respect to said remaining portion of the vehicle and said spur gear between a first position wherein said worm gear is drivingly connected to said spur gear and a second position wherein said worm gear is spaced from said spur gear, said third wheel and worm gear being in said first position when said third wheel is rotting against a surface supporting the toy vehicle.

16. The toy vehicle as recited in claim 9 further including a locking mechanism optionally retaining the pivot mechanism in the drive position regardless of the position of the latch.

* * * * *